US010395795B2

(12) United States Patent
Chen

(10) Patent No.: US 10,395,795 B2
(45) Date of Patent: Aug. 27, 2019

(54) DATA TRANSMISSION CABLE

(71) Applicant: ALLTOP ELECTRONICS (SUZHOU) LTD., Suzhou, Jiangsu Province (CN)

(72) Inventor: Yichang Chen, New Taipei (TW)

(73) Assignee: ALLTOP ELECTRONICS (SUZHOU) LTD., Suzhou, Jiangsu Province (CN)

( * ) Notice: Subject to any disclaimer, the term of this patent is extended or adjusted under 35 U.S.C. 154(b) by 0 days.

(21) Appl. No.: 16/057,646

(22) Filed: Aug. 7, 2018

(65) Prior Publication Data

US 2019/0043641 A1 Feb. 7, 2019

(30) Foreign Application Priority Data

Aug. 7, 2017 (CN) ..... 2017 1 0667017

(51) Int. Cl.

*H01B 7/08* (2006.01)
*H01B 7/02* (2006.01)
*H01B 11/00* (2006.01)

(52) U.S. Cl.

CPC ..... *H01B 7/0823* (2013.01); *H01B 7/02* (2013.01); *H01B 7/0291* (2013.01); *H01B 11/00* (2013.01)

(58) Field of Classification Search

CPC .. H01B 7/0045; H01B 3/441; H01B 11/1834; H01B 11/1839; H01B 7/2825; H01B 11/02; H01B 11/1808; H01B 13/0207; H01B 3/302; H01B 3/446; H01B 3/447; H01B 7/0216; H01B 7/0241; H01B 7/1855; H01B 7/288; H01B 11/002; H01B 11/1826; H01B 11/20; H01B 13/01209; H01B 13/01263; H01B 13/06; H01B 13/141; H01B 13/225; H01B 17/005; H01B 1/02; H01B 3/305; H01B 3/308; H01B 3/421; H01B 3/445; H01B 3/448; H01B 7/0225; H01B 7/17; H01B 7/1875; H01B 7/188; H01B 7/292; H01B 9/02; H01B 9/022; H01B 9/025; H01B 9/027; H01B 9/06

See application file for complete search history.

(56) References Cited

U.S. PATENT DOCUMENTS 3,105,872 A * 10/1963 Thompson ..... H01B 9/06 174/102 R
3,634,782 A * 1/1972 Marshall ..... H01B 7/0861 174/117 F
3,763,306 A * 10/1973 Marshall ..... H01B 7/0838 174/115
5,049,215 A * 9/1991 Strauss ..... H01B 7/0009 156/50
2003/0132022 A1* 7/2003 Williams ..... H01B 7/0823 174/113 R (Continued)

*Primary Examiner* — William H. Mayo, III
*Assistant Examiner* — Krystal Robinson
(74) *Attorney, Agent, or Firm* — Cheng-Ju Chiang

(57) ABSTRACT

A data transmission cable includes a first wire and a second wire adjacent to each other, each of the first wire and the second wire has a central conductor and a cover layer enclosing the conductor, and the conductor of the first wire has an outer diameter same as the conductor of the second wire. The ratio of the center distance between the first wire and the second wire to the outer diameter of the conductor is in the range of 1.7 to 2.35.

17 Claims, 2 Drawing Sheets

(56) References Cited

U.S. PATENT DOCUMENTS

| | | | | |
|---|---|---|---|---|
| 2008/0185167 | A1* | 8/2008 | Lee | H01B 7/0823<br>174/117 F |
| 2008/0304578 | A1* | 12/2008 | Matsubara | H04B 3/30<br>375/257 |
| 2014/0054085 | A1* | 2/2014 | Vermeulen | H01B 7/083<br>174/70 R |
| 2014/0251685 | A1* | 9/2014 | Hatton | H01B 7/0869<br>174/74 R |

* cited by examiner

DATA TRANSMISSION CABLE

CROSS REFERENCE TO RELATED APPLICATIONS

The present application claims the priority of Chinese Patent Application No. 201710667017.6 filed on Aug. 7, 2017, the content of which is hereby incorporated by reference into this application.

BACKGROUND

1. Technical Field

The present disclosure relates to a data transmission cable, and more particularly to a data transmission cable having better high frequency performance.

2. Description of Related Art

In the 3C industry, a transmission cable can be used as a medium for an electrical connection between two electronic devices and can carry out the expected signal transmission stably. Therefore, the transmission cable is widely used in various electronic devices. In particular, transmission cables connected with USB, HDMI, DVI, Displayport and other types of connector has a performance of higher transmission rate, longer transmission distance and higher quality, and is popular with consumers. The transmission cable usually has a plurality of metallic wires, and each metallic wire is wrapped by an insulative layer to avoid short-circuit. However, with the development of computer technology, electronic devices such as computer hard drives or motherboard, have faster data transmission speed, more and more higher transmission frequency. In the field of high frequency or ultra high frequency data transmission, it is very important to control the differential impedance of differential signal wires for ensuring the integrity of high-speed signal, and the traditional wire has been unable to meet the requirements.

It is desirable to provide an improved data transmission cable for solving above problems.

SUMMARY

In one aspect, the present invention includes a data transmission cable comprising a first wire and a second wire adjacent to each other, each of the first wire and the second wire has a central conductor and a cover layer enclosing the conductor, and the conductor of the first wire has an outer diameter same as the conductor of the second wire. The ratio of the center distance between the first wire and the second wire to the outer diameter of the conductor is in the range of 1.7 to 2.35.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
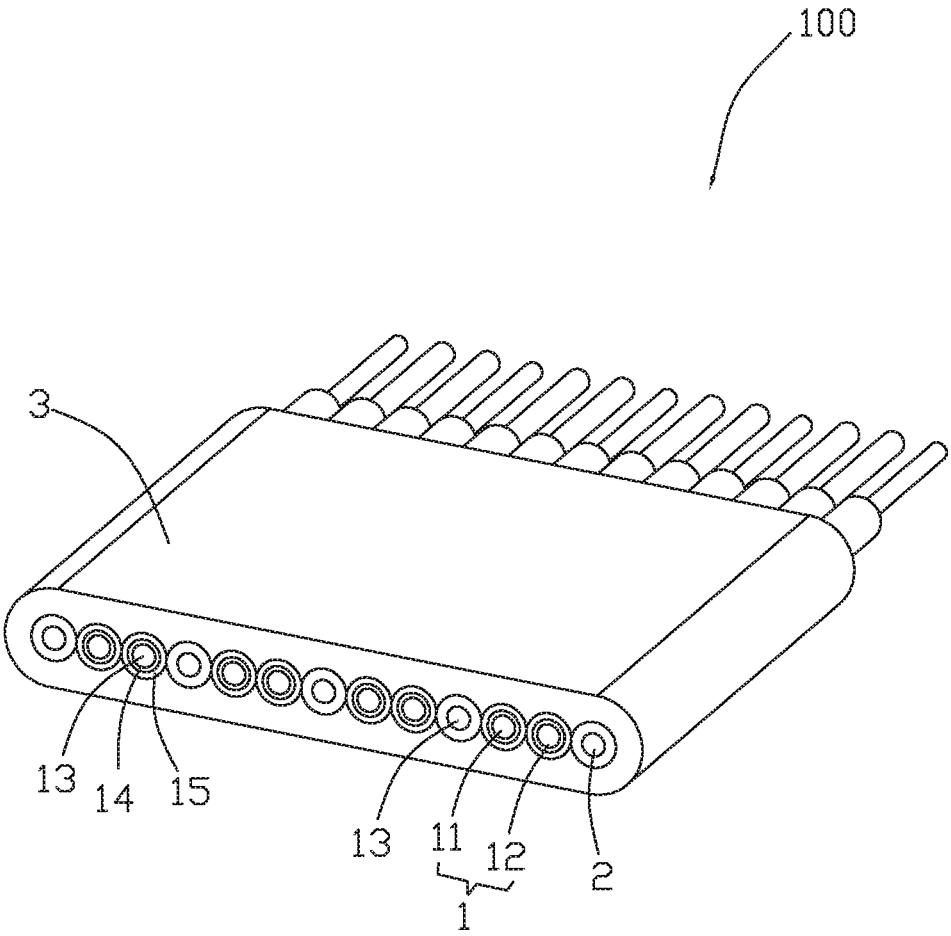
FIG. 1 is a perspective view of a data transmission cable in accordance with an illustrated embodiment of the present disclosure.

Reference will now be made to the drawing figures to describe the embodiments of the present disclosure in detail. In the following description, the same drawing reference numerals are used for the same elements in different drawings.

Figure 2:
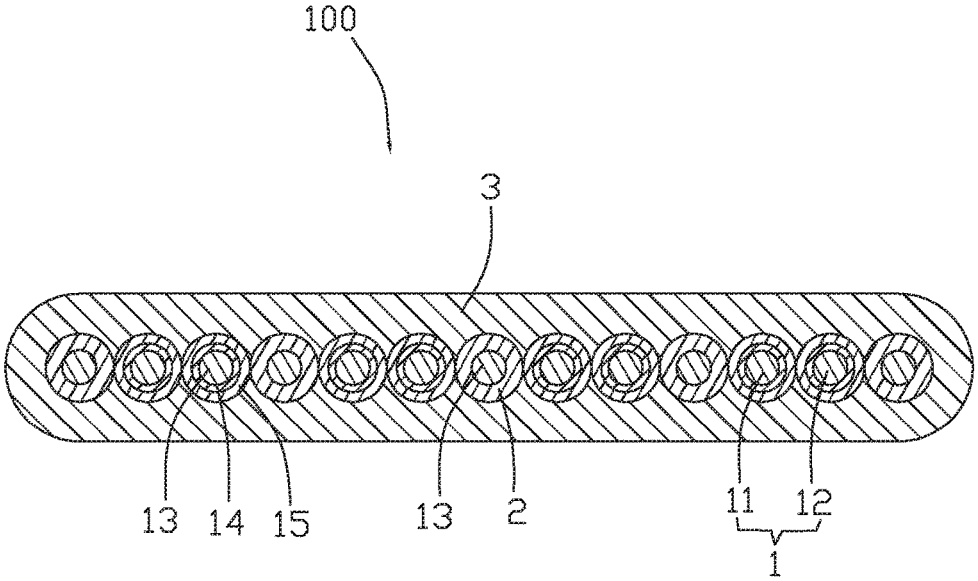
FIG. 2 is a cross-sectional view of the data transmission cable shown in FIG. 1.

Referring to FIGS. 1 to 2, an illustrated embodiment of the present disclosure discloses a data transmission cable 100 comprising at least a wire set 1. The wire set 1 has a first wire 11 and a second wire 12 arranged abreast, and the first wire 11 and the second wire 12 are adjacent to each other.

In the present embodiment, the data transmission cable 100 also has a third wire 2 arranged side by side with the first wire 11 and the second wire 12, and the third wire 2 is neighboring to the first wire 11 or the second wire 12. Among them, the first wire 11 and the second wire 12 are served as a differential pair, for high-frequency signal transmission. The third wire 2 is a grounding wire, for reducing cross-talk on both sides of the differential pair.

In the present embodiment, the data transmission cable 100 has a plurality of juxtaposed differential pairs in a row, and two neighboring differential pairs are spaced apart from each other by one grounding wire 2 located therebetween to prevent mutual interference.

Referring to FIGS. 1 to 2, each of the first wire 11, the second wire 12 and the third wire 2 has a conductor 13 at a center position thereof and a cover layer wrapping on the corresponding conductor 13. Two grounding wires 2 are located on both sides of one differential pair. The first wire 11, the second wire 12 and the third wire 2 are arranged in a row and the central axes of all of the first, second and third wires are located in a same plane.

The conductor 13 of the first wire 11 has an outer diameter same as the conductor 13 of the second wire 12, and the ratio of the center distance between the first wire 11 and the second wire 12 to the outer diameter of the conductor 13 is in the range of 1.7 to 2.35. With the above configuration, the differential impedance between the first wire 11 and the second wire 12 can be reduced effectively by adjusting the setting of the cover layer simply, and the differential impedance between the first wire 11 and the second wire 12 can be controlled in 75 to 110 Ohm, coupling effect therebetween can be enhanced to ensure long distance transmission of high frequency signal.

Among them, the cover layer is set as follows: when the ratio of the center distance between the first wire 11 and the second wire 12 to the outer diameter of the conductor 13 is in the range of 1.7 to 2.35, the differential impedance between the first wire 11 and the second wire 12 can be controlled in 78 to 107 Ohm. Specifically, when the ratio of the center distance between the first wire 11 and the second wire 12 to the outer diameter of the conductor 13 is in the range of 1.7 to 2.0, the differential impedance between the first wire 11 and the second wire 12 is controlled in 78 to 92 Ohm; when the ratio of the center distance between the first wire 11 and the second wire 12 to the outer diameter of the conductor 13 is in the range of 2.05 to 2.35, the differential impedance between the first wire 11 and the second wire 12 is controlled in 93 to 107 Ohm.

Furthermore, when the ratio of the center distance between the first wire 11 and the second wire 12 to the outer diameter of the conductor 13 is in the range of 1.8 to 1.9, the differential impedance between the first wire 11 and the second wire 12 is controlled in 80 to 90 Ohm; when the ratio of the center distance between the first wire 11 and the second wire 12 to the outer diameter of the conductor 13 is in the range of 2.15 to 2.25, the differential impedance between the first wire 11 and the second wire 12 is controlled in 95 to 105 Ohm.

In the present embodiment, the cover layer of each one of the first wire 11 and the second wire 12 comprises a first layer 14 enclosing on the corresponding conductor 13 and a second layer 15 enclosing on the first layer 14. In the present invention, the dielectric coefficient of the first layer 14 is lower than that of the second layer 15.

Furthermore, the first layer 14 is made of insulative material with a lower dielectric coefficient, thus providing a better signal transmission environment for the conductor 13, reducing latency of the signal transmission and crosstalk between signals, to ensure high speed and effective signal transmission and reduce the attenuation of signal.

Additionally, the second layer 15 has a higher dielectric coefficient to suppress external electromagnetic interference, effectively isolate the conductor 13 from outside and ensure high-frequency or super high-frequency signal transmission; in the preferred embodiment the second layer 15 is a wave-absorbing layer, which can absorb electromagnetic wave from outside radiation.

In addition, in the present embodiment, the cover layer of the third wire 2 defines only one layer as the third wire 2 defined as a grounding wire, and the cover layer of the third wire 2 is made of insulative material, for achieving insulation isolation between the conductor 13 of the grounding wire 2 and the conductor 13 of neighboring first wire 11 or second wire 12.

Furthermore, the data transmission cable 100 also has an outer jacket 3 enclosing on the first wire 11, the second wire 12 of the wire set 1 and the grounding wire 2, for retaining and protecting all wires 11, 12, 2 together. The outer jacket 3 can be designed to be a wrapping layer wrapping the wire set 1 and the grounding wire 2 or two films covering an upper side and a lower side of the wire set 1 and the grounding wire 2 simultaneously, and the wire set 1 and the grounding wire 2 are sandwiched and retained between the two films. The outer jacket 3 is made of material with high weather resistance and fatigue resistance performance, such as Thermoplastic Elastomer (TPE) material, to protect the first wire 11, the second wire 12 and the third wire 2 therein, and extend service life of the data transmission cable 100.

The outer jacket 3 has a dielectric coefficient close to that of the second layer 15, thus, the overall dielectric coefficient of the data transmission cable 100 cannot be influenced, and the high frequency signal transmission can be guaranteed.

In the present embodiment, the conductors 13 of the first wire 11, the second wire 12 and the third wire 2 are defined with a same AWG size, the center distance between the third wire 2 and the neighboring first or second wire 11, 12 is equal to the center distance between the first wire 11 and the second wire 12. Furthermore, illustrated in detail, the conductor 13 has an outer diameter (traditionally expressed in AWG size) in the range of 31 to 32 American Wire Gauge (AWG). While the outer diameter of the conductor 13 is 31 AWG, the center distance between the first wire 11 and the second wire 12 is defined greater than 0.38 mm and less than 0.45 mm; and the center distance between the first wire 11 and the second wire 12 is of 0.42 mm preferably, by adjusting the setting of the cover layer, such as adjusting the settings of the first layer 14 and the second layer 15, the differential impedance between the first wire 11 and the second wire 12 is controlled with 85 Ohm.

While the outer diameter of the conductor 13 is 32 AWG, the center distance between the first wire 11 and the second wire 12 is defined in the range of 0.4 mm to 0.5 mm; and the center distance between the first wire 11 and the second wire 12 is of 0.45 mm preferably, by adjusting the setting of the cover layer, such as adjusting the settings of the first layer 14 and the second layer 15, the differential impedance between the first wire 11 and the second wire 12 is controlled with 100 Ohm.

And while the outer diameter of the conductor 13 is 32 AWG, the center distance between the first wire 11 and the second wire 12 is defined in the range of 0.37 mm to 0.38 mm, by adjusting the setting of the cover layer, such as adjusting the settings of the first layer 14 and the second layer 15, the differential impedance between the first wire 11 and the second wire 12 is controlled with 85 Ohm.

Combine with aforementioned specific settings, the wires can be configured according to the requirement, and the conductor 13 can have a smaller outer diameter, thus the first layer 14 and the second layer 15 can be provided with a larger designing space and the overall size of the data transmission cable 100 can be reduced.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A data transmission cable, comprising:

a first wire and a second wire adjacent to each other, each of the first wire and the second wire having a central conductor and a cover layer enclosing the conductor, and the conductor of the first wire has an outer diameter same as the conductor of the second wire;

wherein the ratio of the center distance between the first wire and the second wire to the outer diameter of the conductor is in the range of 1.7 to 2.35, the first wire and the second wire are served as a differential pair, and the cover layer is set to make the differential impedance between the first wire and the second wire be controlled in 78 to 107 Ohm when the ratio of the center distance between the first wire and the second wire to the outer diameter of the conductor is in the range of 1.7 to 2.35.

2. The data transmission cable as claimed in claim 1, wherein when the ratio of the center distance between the first wire and the second wire to the outer diameter of the conductor is in the range of 1.7 to 2.0, the differential impedance between the first wire and the second wire is controlled in 78 to 92 Ohm.

3. The data transmission cable as claimed in claim 2, wherein when the ratio of the center distance between the first wire and the second wire to the outer diameter of the conductor is in the range of 1.8 to 1.9, the differential impedance between the first wire and the second wire is controlled in 80 to 90 Ohm.

4. The data transmission cable as claimed in claim 2, wherein when the ratio of the center distance between the first wire and the second wire to the outer diameter of the conductor is in the range of 2.05 to 2.35, the differential impedance between the first wire and the second wire is controlled in 93 to 107 Ohm.

5. The data transmission cable as claimed in claim 4, wherein when the ratio of the center distance between the first wire and the second wire to the outer diameter of the conductor is in the range of 2.15 to 2.25, the differential impedance between the first wire and the second wire is controlled in 95 to 105 Ohm.

6. The data transmission cable as claimed in claim 1, wherein the cover layer of each one of the first wire and the second wire comprises a first layer enclosing on the corresponding conductor and a second layer enclosing on the first layer, and the dielectric coefficient of the first layer is lower than that of the second layer.

7. The data transmission cable as claimed in claim 6, wherein the first layer is made of insulative material, and the second layer is a wave-absorbing layer.

8. The data transmission cable as claimed in claim 6, wherein when the outer diameter of the conductor is 31 AWG, the center distance between the first wire and the second wire is defined greater than 0.38 mm and less than 0.45 mm, the differential impedance between the first wire and the second wire is controlled with 85 Ohm.

9. The data transmission cable as claimed in claim 8, wherein the center distance between the first wire and the second wire is 0.42 mm.

10. The data transmission cable as claimed in claim 6, wherein when the outer diameter of the conductor is 32 AWG, the center distance between the first wire and the second wire is defined in the range of 0.4 mm to 0.5 mm, the differential impedance between the first wire and the second wire is controlled with 100 Ohm.

11. The data transmission cable as claimed in claim 10, wherein the center distance between the first wire and the second wire is 0.45 mm.

12. The data transmission cable as claimed in claim 6, wherein when the outer diameter of the conductor is 32 AWG, the center distance between the first wire and the second wire is defined in the range of 0.37 mm to 0.38 mm, the differential impedance between the first wire and the second wire is controlled with 85 Ohm.

13. The data transmission cable as claimed in claim 1, wherein the first wire and the second wire are served as a differential pair, and the data transmission cable further comprises a third wire arranged side by side with the first wire and the second wire, the third wire is a grounding wire.

14. The data transmission cable as claimed in claim 13, wherein the third wire is neighboring to the first wire or the second wire, and also has a conductor at a center position thereof and a cover layer wrapping on the conductor.

15. The data transmission cable as claimed in claim 14, wherein the conductors of the first wire, the second wire and the third wire are defined with a same AWG size, and the center distance between the third wire and the neighboring first or second wire is same as the center distance between the first wire and the second wire.

16. The data transmission cable as claimed in claim 15, wherein the data transmission cable comprises two third wires located on opposite sides thereof.

17. The data transmission cable as claimed in claim 16, wherein the first wire, the second wire and the third wires are arranged in a row and the central axes of all of the first, second and third wires are located in a same plane.

* * * * *